United States Patent [19]

Hirt et al.

[11] 4,031,830

[45] June 28, 1977

[54] SAFETY CLAMPING DEVICE FOR PULL-CABLE IN AERIAL CABLEWAY ARRANGEMENT

[75] Inventors: Peter Klaus Hirt, Farchant; Kurt Switzeny, Cologne, both of Germany

[73] Assignee: Pohlig-Heckel-Bleichert Vereinigte Maschinenfabriken Aktiengesellschaft, Cologne-Zollstock, Germany

[22] Filed: Jan. 27, 1976

[21] Appl. No.: 652,759

[30] Foreign Application Priority Data

June 14, 1975 Germany ..... 2526745

[52] U.S. Cl. ..... 104/223; 24/115 R; 24/115 G; 104/202; 403/11; 403/32

[51] Int. Cl.[2] ..... B61B 12/12

[58] Field of Search ..... 104/202, 239; 188/65.1; 24/115 R, 115 F, 115 G, 136 R; 403/11, 28, 32

[56] References Cited

UNITED STATES PATENTS 2,840,008 6/1958 Lodvick et al. ..... 104/202 X 3,605,491 9/1971 Senn ..... 104/209 X

FOREIGN PATENTS OR APPLICATIONS 168,952 1/1951 Austria ..... 104/202

*Primary Examiner*—Robert J. Spar
*Assistant Examiner*—Randolph A. Reese
*Attorney, Agent, or Firm*—Karl W. Flocks

[57] ABSTRACT

A safety clamping device for a pull-cable arrangement for use in an aerial cableway comprising a pair of clamping jaws provided with cable-clamping cups disposed internally thereof, a plurality of synthetic-resin strips interposed between the cable-clamping cups and the clamping jaws and a spring storage device disposed in pressure relationship between one of the clamping jaws and a pressure plate whereby a frictional coupling is provided for a pull-cable and a trolley under normal operation, but being effective to drop the synthetic-resin strips and release the pull-cable, to detension the spring device in reaction to increase in friction and/or heat as a protection against development of excessive friction and/or heat.

6 Claims, 6 Drawing Figures

SAFETY CLAMPING DEVICE FOR PULL-CABLE IN AERIAL CABLEWAY ARRANGEMENT

BACKGROUND OF THE INVENTION

1. Field of the Invention

The present invention relates to a safety clamping device for a pull-cable in an aerial cableway, providing an overload protection between a pull-cable and a trolley of a cableway cabin.

2. Description of the Prior Art

Pull-cable sleeves have heretofore been disclosed as means of connection between the pull-cable and the trolley, some of these prior art pull-cables being anchored in an inner cone of such sleeves. Frequently because of improper casting of prior art clamping devices, water is able to penetrate the parts associated therewith and corrode the cable and clamp. Also, constantly reversing bending stresses of the separate wires during the spatial swinging of the pull-cable necessitates periodic inspection of the cable in such area which is a relatively expensive operation. The trolley cannot be shifted. Under such an arrangement, the position subjected to the greater risks is situated in the area of the end of cone, i.e., the area where the pull-cable frequently breaks, as shown by practical experience.

There are also known mechanical pull-cable clamps, that are equipped with a spring energy storage device or the like. The cable in the area of clamping is left in the original state when the mechanical pull-cable clamps are used. The trolley can be shifted on the pull-cable and the positions of increased susceptibility to cable breakage and corrosion are avoided.

On the other hand, the arrangement of two clamps on the trolley, as required by regulations, involves a stretching of the pull-cable between the two clamps, because of the tension, and of the two clamps one must transmit by far higher tension than it would be required on the basis of the downward-slope force of the trolley, so that further additional devices should be provided.

SUMMARY OF THE INVENTION

Along with the foregoing considerations, applicant has also taken into account the fact that the pull-cable is constantly held under tension during the operation, that such a tension, e.g., produced by a weight, may be counteracted by a force corresponding in size to the tension, for the purpose of force equalization. When the cable breaks, the equalization of forces is disrupted, i.e., the force counteracting the tension becomes free and exerts itself as an acceleration in the direction opposite to the direction of the cable break. Accordingly, if the cable breaks away from the clamping device in the direction toward the mountain, there occurs an acceleration toward the valley and if the cable breaks in the direction of the valley in front of the clamping device, there occurs an acceleration toward the mountain, in which connection there is still added in both cases the force produced by the counterweight, if such a weight acts on the cable end which is still held by the clamping device.

Accordingly, the cable breakage disturbs the previously prevailing equalization of forces in the pull-cable with the result that the force acting in the clamped cable piece tends to pull such a piece from the clamp to a certain extent frequently results in such a high temperature or such a high friction that in an extreme case a fusing or welding of the cable to the clamping cups which hold it occurs and, on the other hand, the cable acts like a milling cutter in relation to the inner surfaces of the cups, at least with its rough surface.

This very strong friction, which suddenly appears between the cable and the clamping cups, can be opposed by the unchanged or constant friction between such cups and the strips of synthetic resin.

The clamping cups are thrown or torn out of the device during this and the clamping device releases also the cable piece held until such a time, so that the forces present therein suddenly stop to act on the trolley.

The material of the synthetic-resin strips is to be determined in this connection in accordance with its fusibility, or even the capacity to produce friction, stability in regard to water, tensile and compression strength.

The present invention provides structure for preventing, in the case of pull-cable breakage, the reduction of the force corresponding to the cable tension and acting on the trolley, with a safe increase and in accordance with the traversed distance, and also to avoid the disadvantages of the known means of connection between trolley and pull-cable.

According to the invention, the objects set forth above are achieved by arranging cable-clamping cups, which bilaterally embrace the pull-cable within the lower cable-clamping jaw and the upper cable-clamping jaw, and a number of synthetic-resin strips distributed, between the cable-clamping cups and the cable-clamping jaws, through the circumference and the length of the clamped pull-cable and a spring energy storage device or a plurality of such devices that can actuate a cable-clamping jaw, react to pressure and are secured by means of a pressure plate, which on the one hand, in the case of normal operation, provides a frictional connection between the trolley and the pull-cable, while, on the other hand, in the case of pull-cable breakage, provides a dropping of the synthetic-resin strips and a release of the pull-cable and a detensioning of the spring energy storage devices.

A preferred embodiment of the present invention provides a safety clamping device for pull-cables with a thermal overload protection, in which connection there is a form-locking and force-locking coupling between the cable-clamping jaws and the cable-clamping cups and the inner side of the cable-clamping cups, that are arranged on either side inside the cable-clamping jaws, is substantially half-round and with synthetic-resin strips disposed in the longitudinal direction and arranged at right angle to each other to react in particular to heat, owing to which, through the spring energy storage devices that release a pressure, there is effected a fusion of the synthetic resin strips and a detensioning of the spring energy storage devices on breakage of the pull-cable and on appearance of the high temperatures associated therewith.

An alternative embodiment of the invention provides a safety clamping device for pull-cables constructed as friction overload protection, in which connection a frictional coupling of the cable-clamping jaws and the cable-clamping cups is provided on the one hand, during the normal operation, by means of the spring energy storage device and, on the other hand, in the case of pull-cable breakage, an ejection of the cable-clamping cups and a release of the pull-cable is provided through the constant friction on the clamping jaws and the substantially higher friction on the pull-cable.

Further, it has turned out as an advantage to arrange the pressure-responsive spring storage device above the upper cable-clamping jaw.

The cable-clamping cups are expediently arranged in this connection in the grooves of the cable-clamping jaws.

BRIEF DESCRIPTION OF THE DRAWINGS

Further advantages and characteristics of the invention will be appreciated upon reference to the drawings of which.

DETAILED DESCRIPTION OF THE INVENTION

Figure 1:
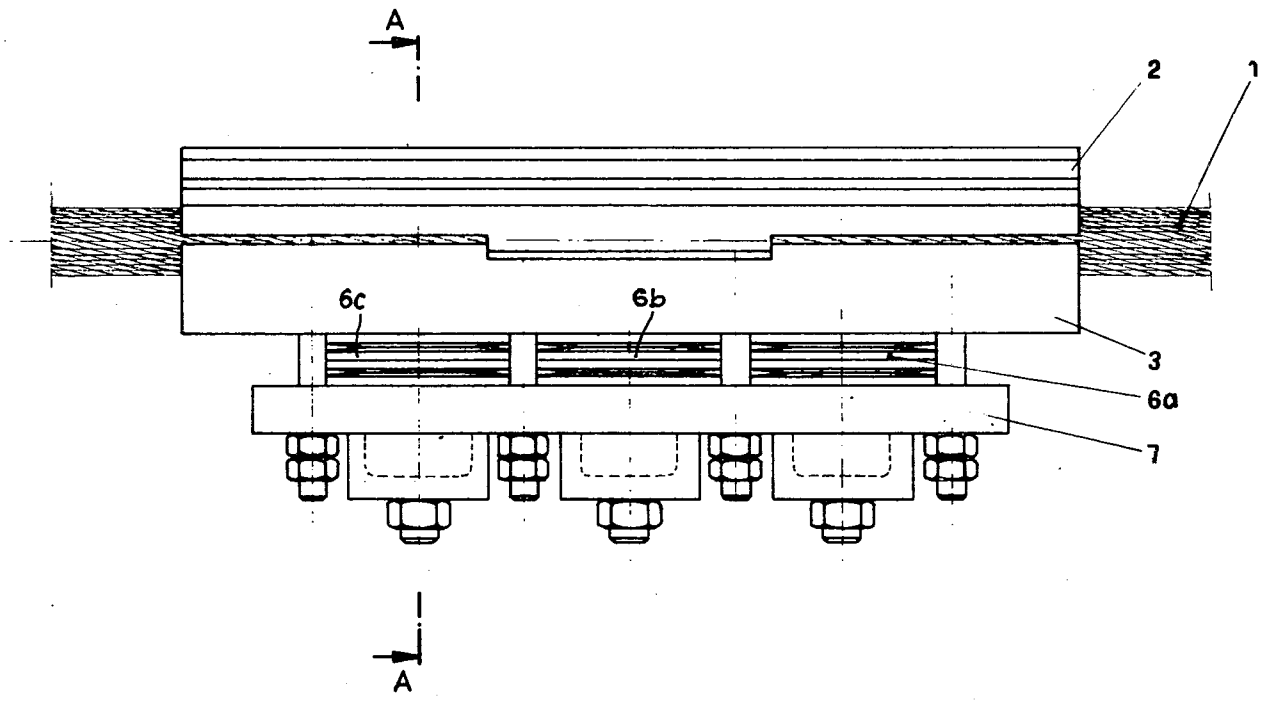
FIG. 1 shows the pull-cable clamping device of the present invention in lateral elevation.
Figure 2:
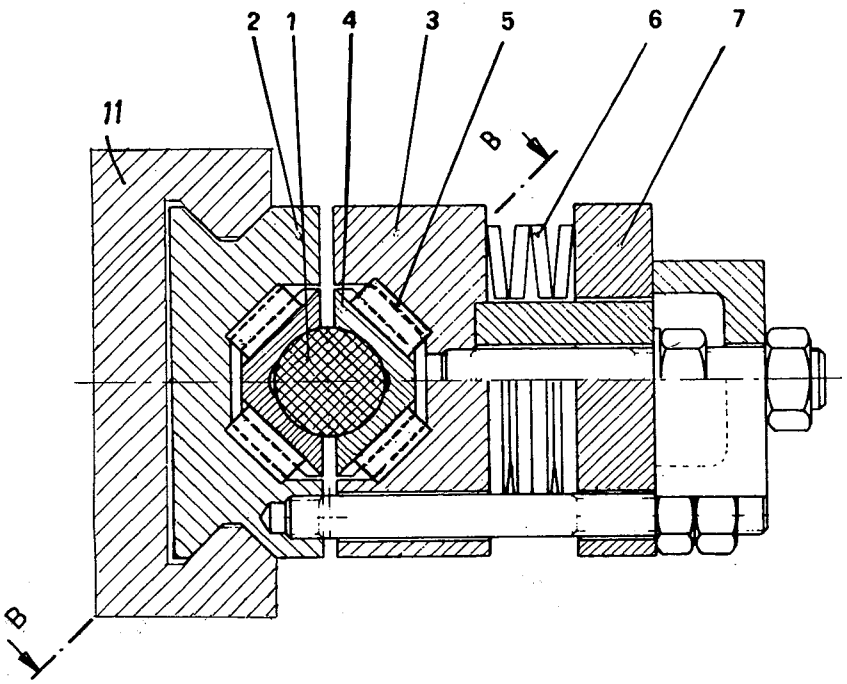
FIG. 2 shows a vertical section taken along the line A—A of FIG. 1 and rotated 90° in the counterclockwise direction.
Figure 3:
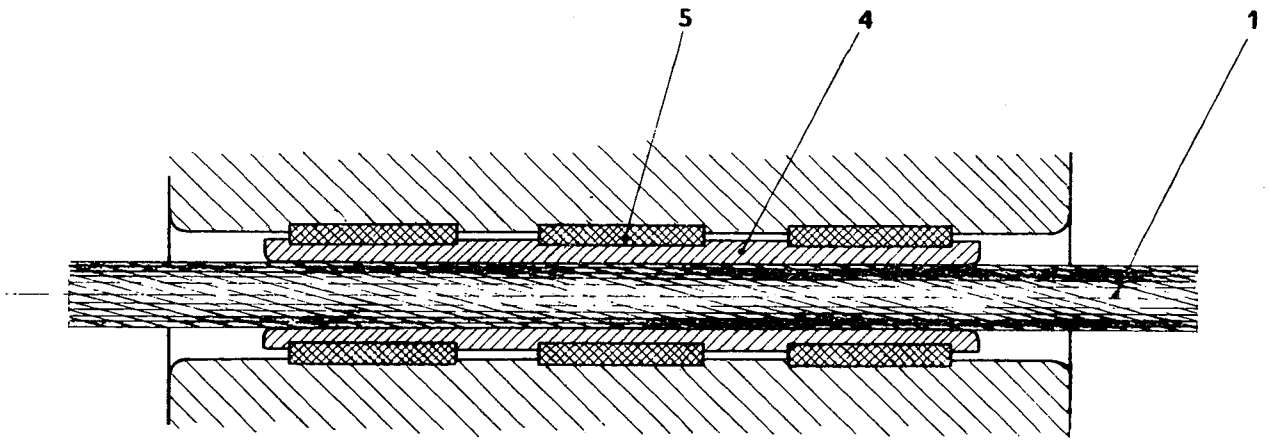
FIG. 3 shows a section taken along the plane B—B of FIG. 2.

Referring now with greater particularity to the drawings, the reader will see that the present invention provides a safety pull-cable clamping device arranged, for example, on a pull-cable 1 of an aerial cableway or its trolley 11 shown in FIG. 2 which comprises a lower cable-clamping jaw 2 and an upper cable-clamping jaw 3. Half-round clamping cups 4 are arranged on both sides of cable 1 within such jaws 2, 3. Clamping cups 4 are joined to cable-clamping jaws 2, 3 by means of synthetic-resin strips 5, that are developed in longitudinal direction, arranged at right angles to each other and react, in particular, to heat. The purpose of such strips is to provide thermal overload protection.

A spring storage device 6 is placed against an outer surface of cable-clamping jaw 2 to react to pressure and is associated with pressure plate 7 in pressure contacting relationship thereagainst. breakage and the high temperature produced by such breakage in The arrangement, as described, provides a frictional connection between pull-cable 1 and the trolley or a form-locking and force-locking connection between cable-clamping jaws 2, 3 and cable-clamping cups 4. In the case of pull-cable breakage and the high temperature produced by such breakage in the cable area, this arrangement also ensures fusion of synthetic-resin strips 5, a detensioning of spring-storage device 6 and an ejection of clamping cups 4.

A substantially closed, cable-sparing embodiment of the invention provides a protection of the critical cabel areas against corrosion and cable breakage, cable-clamping jaws 2, 3 enclosing a relatively long portion of the pull-cable. Substantially no cable stretching occurs between the two pull-cable clamping devices arranged on the trolley, since such stretching is compensated by the elastic synthetic-resin strips.

Figure 4:
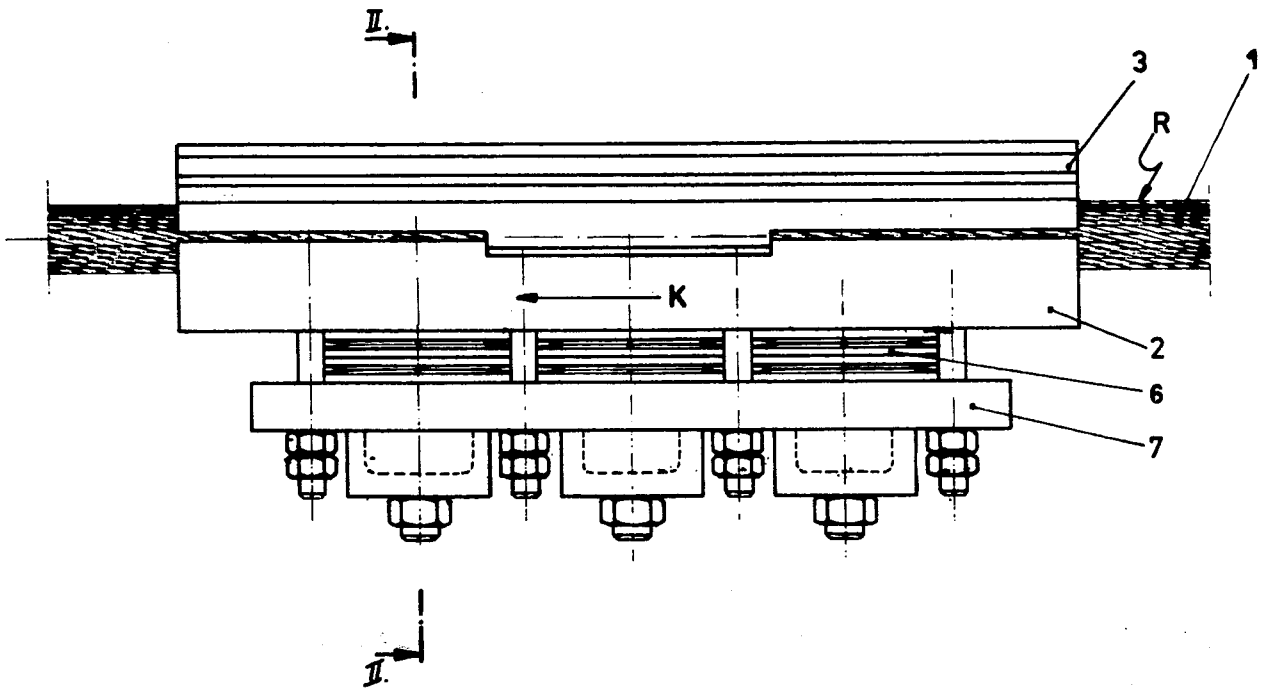
FIG. 4 shows an alternative embodiment of the invention in lateral elevation.
Figure 5:
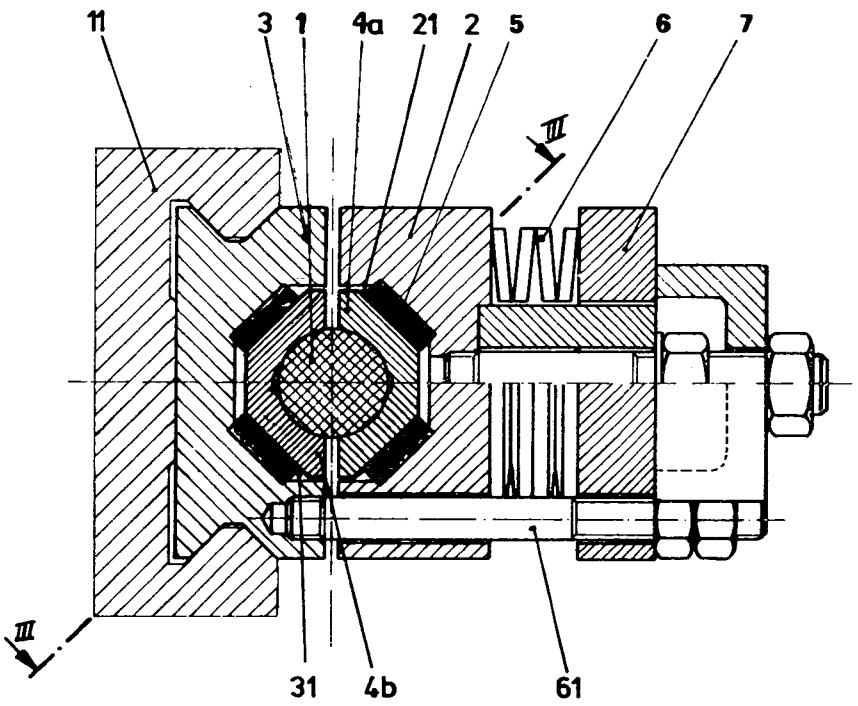
FIG. 5 shows a vertical section taken along the plane II—II of FIG. 4 and rotated 90° in the counterclockwise direction.
Figure 6:
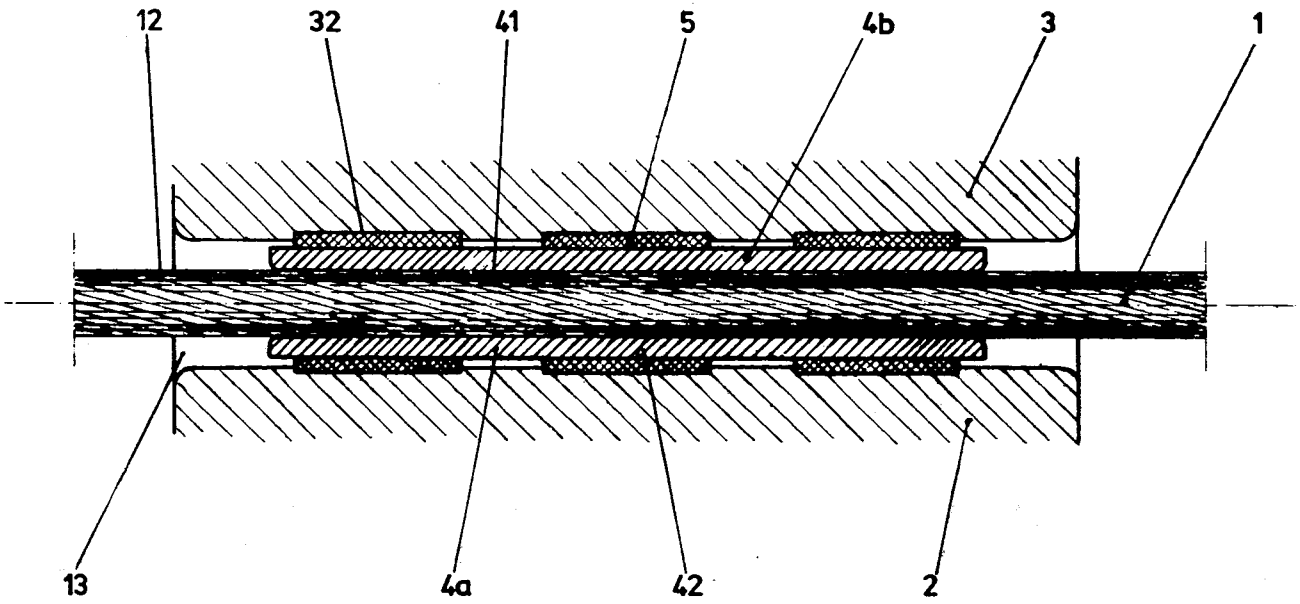
FIG. 6 shows a section along the plane III—III of FIG. 5.

In a further exemplified embodiment of the invention, the safety pull-cable clamping device consists of a friction-overload protection FIG. 4 – FIG. 6. The safety pull-cable clamping device attached to trolley 11 comprises lower cable clamping jaw 2 and upper cable-clamping jaw 3, with recesses 21 and 31 defining a cavity, which contains clamping cups **4*a*, 4*b*, that surround pull-cable 1** with their inner surfaces.

Frictional connection between clamping jaws 2, 3 and clamping cups **4*a*, 4*b* is provided and maintained during the normal operation through synthetic-resin strips 5 by means of spring-storage device 6. In the example shown, spring device 6 comprises three individual spring piles 6*a*, 6*b* and 6*c* arranged side by side in a row and resting against pressure plate 7, on the one hand, and against lower clamping jaw 2, on the other hand, so as to support lower clamping jaw 2 guided by bolts 61 and applying distancing pressure on pressure plate 7. In this arrangement, cable-clamping jaws 2 and 3 are pressed toward each other and such a pressure is transmitted through synthetic-resin strips 5 to cable-clamping cups 4*a* and 4*b***. The pressure force of the spring storage device is so selected that, with due consideration for the coefficient of friction, the clamping force is sufficient to absorb the forces occurring during normal operation such as downward force due to slope, acceleration and braking forces so that with an increase at a suitable safety factor the frictional connection between the pull-cable and the cable clamp is ensured.

When the cable breaks, e.g., at R in FIG. 4, the cable tension produces an axially-directed force indicated by an arrow K. The force generates such a strong heating on a contact surface 41 between clamping jaws 2, 3 and cable 1 that the friction between cable 1 and clamping cups **4*a*, 4*b* is substantially increased, while the value of friction at a contact surface 42 between clamping cups 4*a*, 4*b* and synthetic-resin strips 5 does not change or changes only to a non-substantial extent. Owing to this, the friction becomes too low for maintaining a frictional connection between clamping jaws 2 and 3 and clamping cups 4, i.e., clamping cups 4*a*, 4*b* are torn or thrown in the direction of arrow K from a space 13 between clamping jaws 2 and 3 and cable end 12** is dropped.

The number of synthetic-resin strips 5 through the circumference and the length of the cable piece contained in the device depends on the diameter of the cable, the weight of the vehicle, the load and the polygonal shape of the clamping cups, among other factors. In the example which is illustrated, four synthetic-resin strips 5 are distributed over the circumference in three positions arranged one after another, i.e., the total number of the synthetic-resin strips is twelve. The strips may be arranged in grooves 32 of cable-clamping jaws 2, 3 for the purpose of centering.

Owing to the fact that the invention provides separately a thermal or a frictional overload protection or both such protections, various considerations can be taken into account when the material is selected: the synthetic resin can be chosen in accordance with the criteria of stability under heat such as resistance to heat, fusibility, tensile and compression strength, notch impact strength, shrink resistance, resistance to cold and the like.

This can be considered as advantage for the safety of aerial cableways, owing to the fact that safety and sturdiness should be combined precisely in the operation of mountain railways which comprises extreme differences in weather conditions.

Although the invention has been described with a certain degree of particularity, it is understood that the present disclosure has been made only be way of example and the numerous changes in details of construction and the combination and arrangement of parts may be resorted to without departing from the spirit and scope of the invention as hereinafter claimed.

What is claimed is:

1. A safety clamping device for a pull-cable in an aerial cableway by which overload protection may be provided between a pull-cable and a trolley of a cableway cabin, said clamping device comprising a first cable-clamping jaw and a second cable-clamping jaw, cable-clamping cups disposed between said cable-clamping jaw, a pull-cable extending between said cable clamping jaws and bilaterally embraced thereby, at least one spring storage means urging said cable clamping jaws toward each other, and a number of synthetic-resin strips extending between said cable-clamping cups and said cable-clamping jaws along the circumference and the length of said clamping device, a pressure plate abutting against one end of said spring storage means with said spring storage means operating against said pressure plate in the case of normal operation of said clamping device to provide a frictional coupling between the trolley and the pull-cable and to store energy, while on the other hand, in the case of pull-cable breakage to allow said synthetic-resin strips to be dropped and said pull-cable to be released and said spring storage means to be detensioned to effect reaction pressure developed and stored by said spring means and transmitted to said cable-clamping jaws.

2. A safety clamping device as defined in claim 1, characterized in that said pressure responsive spring storage means is arranged above an upper cable-clamping jaw.

3. A safety clamping device according to claim 1 wherein the synthetic strips are made of a fusible synthetic resin.

4. A safety clamping device according to claim 1, wherein the synthetic strips are flat strips extending in the longitudinal direction of the clamping cups and comprise two such strips arranged at right angles to each other disposed between each clamping jaw and the corresponding clamping cup.

5. A clamping device according to claim 1 wherein said spring storage means comprise at least two spring members having a common pressure plate on which each abuts.

6. A clamping device according to claim 1, wherein the synthetic strips are disposed in grooves in the cable-clamping jaws.

* * * * *